US007234622B2

(12) United States Patent
Masuda et al.

(10) Patent No.: US 7,234,622 B2
(45) Date of Patent: Jun. 26, 2007

(54) STAPLER, CARTRIDGE FOR STAPLER, AND SYSTEM HAVING THE STAPLER AND CARTRIDGE IN COMBINATION

(75) Inventors: Takashi Masuda, Tokyo (JP); Jun Maemori, Tokyo (JP); Akira Aoki, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 10/490,958

(22) PCT Filed: Sep. 26, 2002

(86) PCT No.: PCT/JP02/09980

§ 371 (c)(1),
(2), (4) Date: Mar. 26, 2004

(87) PCT Pub. No.: WO03/028957

PCT Pub. Date: Apr. 10, 2003

(65) Prior Publication Data

US 2004/0245310 A1 Dec. 9, 2004

(30) Foreign Application Priority Data

Sep. 28, 2001 (JP) ..... 2001-304565

(51) Int. Cl.
*B25C 5/16* (2006.01)

(52) U.S. Cl. ..... 227/135; 227/120; 227/131; 227/136; 206/340

(58) Field of Classification Search ..... 227/120, 227/131, 135, 136, 51, 109, 132, 156; 270/58.08; 206/340
See application file for complete search history.

(56) References Cited

U.S. PATENT DOCUMENTS 4,569,469 A * 2/1986 Mongeon et al. ..... 227/19
4,588,121 A * 5/1986 Olesen ..... 227/120

(Continued)

FOREIGN PATENT DOCUMENTS

JP Y2-55-028457 7/1980

(Continued)

*Primary Examiner*—Christopher Harmon
(74) *Attorney, Agent, or Firm*—Morgan, Lewis & Bockius LLP

(57) ABSTRACT

It is a task of the present invention to provide a stapler of a small size, the structure of which is simple, into which a large number of staples can be charged. It is also a task to provide a cartridge, the structure of which is simple, containing the staples and attached to the stapler.

The present invention provides a stapler in which a sheet-shaped staple connecting body is used and a staple is formed into a C-shape and stricken out by operating a handle, and the stapler includes: a handle; a pressing member; and a magazine portion having a protrusion by which the sheet-shaped staple connecting body can be horizontally lifted up on a bottom face of a magazine, the present invention also provides a box-shaped cartridge composed of one piece of sheet, the thickness of which is smaller than the height of the protrusion, containing the sheet-shaped staple connecting body, and the box-shaped cartridge includes: a cutout engaging with a protrusion provided in the magazine portion; cutout portions, which are respectively formed in the front and the rear, in which at least one row of the sheet-shaped staple forming body can pass through; a flexible protrusion hanging from an upper portion of the cutout portion; and a hole in which the pressing member of the cartridge can pass through and the sheet-shaped staple connecting body can not pass through, and the present invention also provides a system which is used when the cartridge is attached into the magazine portion of the stapler.

6 Claims, 7 Drawing Sheets

U.S. PATENT DOCUMENTS

| | | | | | |
|---|---|---|---|---|---|
| RE33,362 | E | * | 10/1990 | Mongeon et al. | 227/19 |
| 5,501,387 | A | * | 3/1996 | Yoshie | 227/120 |
| 5,676,299 | A | * | 10/1997 | Yoshie et al. | 227/120 |
| 6,039,230 | A | * | 3/2000 | Yagi et al. | 227/120 |
| 6,705,504 | B1 | * | 3/2004 | Kanai et al. | 227/135 |
| 2002/0125293 | A1 | * | 9/2002 | Sugihara et al. | 227/131 |
| 2005/0011787 | A1 | * | 1/2005 | Yoshie | 206/340 |

FOREIGN PATENT DOCUMENTS

| | | |
|---|---|---|
| JP | U-60-134586 | 9/1985 |
| JP | U-4-07670 | 8/1992 |
| JP | A-8-99273 | 4/1996 |
| JP | 8-229846 | 9/1996 |
| JP | B2-2663801 | 6/1997 |
| JP | 2002-210675 | 7/2002 |

* cited by examiner

STAPLER, CARTRIDGE FOR STAPLER, AND SYSTEM HAVING THE STAPLER AND CARTRIDGE IN COMBINATION

TECHNICAL FIELD

The present invention relates to a stapler which is one kind of stationery generally used in common-houses and offices. The present invention also relates to a cartridge for containing staples to be replaced.

BACKGROUND ART

In a manually operated stapler, which is a kind of stationery generally called "Hotchkiss" and used in common-houses, offices and manually operating sections in factories, C-shaped staples are mostly used as described in JP-Y2-55-028457.

C-shaped staples are formed in such a manner that dozens of staples detachably bonded to each other constitute a row of staple. The staples are charged into a magazine portion of a stapler, keeping the row. When a handle is manually pressed down so as to make a driver, which is linked with the handle, go down, the staples are stricken one by one into sheets of paper to be stapled. In this way, the sheets of paper are stapled. When the above series of stapling work is conducted, the staples are fed out to the striking portion and to clincher portion by a stapler feed mechanism.

However, in the case where the staples are formed into a C-shape, only 100 to 200 staples can be charged into the stapler at the same time, that is, a large number of staples can not be charged into the stapler by one operation.

Therefore, for example, when the conventional stapler, in which C-shaped staples are used, is used in an office or a manually operating section of a factory where a large number of staples are consumed, it is necessary to frequently carry out a staple charging operation in the case where staples accommodated in the magazine of the stapler are used up, that is, the stapling operation is very inefficient. In order to avoid charging staples highly frequently, it is necessary to accommodate a very large number of C-shaped staples in the stapler. Accordingly, dimensions of the stapler body are necessarily increased.

As described in JP-B2-2663801 and JP-A-08-229846, in the case that an electric stapler is built in a copier or printer, linear staples are used. In this case, the linear staples are arranged in a row of a predetermined length being formed into a sheet-shape, and a large number of the thus obtained sheets of staples are stacked each other and charged into the stapler.

Concerning the method of charging the staples into the electric stapler, a large number of sheet-shaped staple connecting bodies are stacked and accommodated in a refill cartridge, and the refill cartridge is further accommodated in a cartridge. In this case, the refill cartridge is defined as an inner cartridge attached inside the cartridge, and the inner cartridge accommodates a large number of stacked sheet-shaped staple connecting bodies.

As described in JP-A-08-099273, the refill cartridge is a box-shaped structure made of a sheet of paper or a thin resin sheet, the front and the upper portion of which are completely open. When the refill cartridge is used, it is inserted so that a face with an opening of the refill cartridge directs to the staple striking side. After the insertion of the refill cartridge, a bundling tape is removed.

When the cartridge, in which the refill cartridge containing staples is provided, is inserted into the magazine portion of the electric stapler, the staple charging work of the electric stapler is completed. At the same time, the sheet-shaped staple connecting body is pressed to a floor face of the refill cartridge by a member disposed on an upper face of the inside of the cartridge, for pressing the sheet-shaped staple connecting body. Therefore, the sheet-shaped staple connecting body can be fed being slid on the floor face of the refill cartridge. In this way, the electric stapler can be put into a usable state.

In the case of actually striking the staples, the driver operated synchronously with the rotation of a motor is made to go down, and the staples are stricken one by one into sheets of paper to be stapled. In this way, the sheets of paper can be stapled. When the above series of stapling work is conducted, the staples are successively fed to the striking portion and to the clincher portion by the feeding mechanism such as a roller and pushing member which are interlocked with the motion of the driver.

In order to solve the problems of the stapler having a very large number of C-shaped staples, that is, in order to solve the problems that the dimensions of the stapler are increased, it is possible to consider the structure described in Japanese Patent Application Number. 2001-12520, in which not C-shaped staples but linear staples are used and a large number of linear staples are detachably bonded to each other and charged into the stapler and bent into a C-shape by a mechanism provided on the stapler side in the process of stapling.

Constitution of this invention is described as follows. A sheet-shaped staple connecting body is included in the cartridge made of paper or rigid synthetic paper. The cartridge is attached to the magazine portion of the stapler. When a C-shaped arm member and a pressure member supported by the C-shaped arm member are inserted into the cartridge, the upper portion of which is open, the sheet-shaped staple connecting body is pressed to a bottom portion of the cartridge, so that the sheet-shaped staple connecting body is fed to the stapling mechanism by the feeding mechanism.

However, in the manual stapler in which the cartridge made of synthetic paper and the sheet-shaped staple connecting body are used, it is necessary to be able to easily open the magazine portion, and at the same time, it is necessary to be able to simply charge staples into the stapler in a similar manner to that of the conventional manual stapler. Unless the manual stapler, in which the cartridge made of synthetic paper and the sheet-shaped staple connecting body are used, is composed as described above, the stapler will be more inconvenient than the conventional stapler when it is used, that is, there is a possibility that the stapler can not be widely used.

Furthermore, the cartridge used for the conventional electric stapler has a polarity with respect to the longitudinal direction of the cartridge. Therefore, when the cartridge is erroneously set to the conventional electric stapler, it is impossible to use the stapler appropriately. Therefore, in the case where the cartridge of the manual stapler has a polarity in the longitudinal direction of the cartridge, for example, it is difficult for a person who is bad with machines to simply use the stapler.

Further, when the cartridge is composed of not a single part but a plurality of parts, from the viewpoints of manufacturers, since the number of parts is increased in the manufacturing process, the assembling work becomes complicated and the number of manufacturing processes is increased. From the viewpoints of consumers, there is a possibility that the parts are detached and lost. Therefore, when the cartridge is composed of not a single part but a plurality of parts, it is inefficient that the stapler is handily operated in the same manner as that of the conventional manual stapler, which causes an increase in the manufacturing cost.

Furthermore, only when the cartridge is formed into a box-shape, the feed mechanism for feeding the sheet-shaped staple connecting body does not operate properly. In the case where the sheet-shaped staple connecting body is directly put into the box-shaped cartridge, friction caused between the bottom face and the sheet-shaped staple connecting body is increased, and the cartridge is abraded. Accordingly, there is a possibility that the cartridge is damaged in the stapler before the sheet-shaped staple connecting body is used up. In addition, only when the cartridge is formed into a box-shape and has an opening portion for feeding a sheet-shaped staple connecting body, there is a high risk that the sheet-shaped staple connecting body drops from the cartridge while the cartridge is being conveyed.

Further, in the case of the cartridge concerned, when the member, which is provided on the inner roof of the cartridge of the conventional electric stapler so as to press the sheet-shaped staple connecting body to the cartridge floor, is adopted, the structure becomes complicated and further the number of parts is increased. Furthermore, it becomes necessary to enhance the mechanical strength of each member, which causes an increase in the manufacturing cost. Therefore, the member to press the sheet-shaped staple connecting body to the cartridge floor can not be provided.

Therefore, although it is necessary to provide on the stapler side the above member for pressing the sheet-shaped staple connecting body to the cartridge floor, the cartridge must be provided with a structure to receive the above pressing member.

The present invention has been accomplished to solve the above problems. It is an object of the present invention to prevent an increase in the dimensions of a stapler body compared with the stapler, in which C-shaped staples are used, by adopting the cartridge of the present invention when a large number of sheet-shaped staple connecting bodies are charged into the stapler.

It is another object of the present invention to simply attach a cartridge containing a sheet-shaped staple connecting body to the stapler and reduce a possibility that the staples are erroneously charged.

It is still another object of the present invention to prevent a sheet-shaped staple connecting body from dropping off from a cartridge in the process of conveying the cartridge when the device is composed so that the damage of the cartridge can not be caused in the magazine.

It is still another object of the present invention to provide a cartridge having both the function of an outer cartridge to be attached to a stapler and the function of a refill cartridge in which staples are only contained.

It is still another object of the present invention to provide a stapler, a cartridge and a system in which the stapler and cartridge are combined with each other, characterized in that: the generation of refuse is prevented by using a thin plate for composing a cartridge; and even when the cartridge is composed of the thin plate, the structure can be made simple while the above structural conditions are being satisfied.

In the above system, even when two or more sheets of sheet-shaped staple connecting bodies are sent to the stapling system, only one sheet of sheet-shaped staple connecting body is made to pass in the actual stapling mechanism, so that the stapler can be prevented from jamming and damaging.

SUMMARY OF THE INVENTION

In order to accomplish the above objects, the present invention provides (1) a stapler comprising: a sheet-shaped staple connecting body in which a plurality of linear staples are continuously connected to each other; a staple feeding means that feeds the sheet-shaped staple connecting body; a striking means for striking a staple in the front portion of the sheet-shaped staple connecting body while the staple is being formed into a C-shape when the striking means comes into contact with the staple; a magazine portion which is a means for charging the sheet-shaped staple body; a handle for operating the striking means; and a staple pressing means, mounted below the handle, that presses the sheet-shaped staple connecting body in a cartridge charged into the magazine to a bottom face of the magazine portion, wherein the magazine is formed into a recess-shape having a protrusion capable of maintaining the sheet-shaped staple connecting body in a state in which the sheet-shaped staple connecting body is horizontally lifted from the bottom face of the magazine portion.

Further the present invention provides (2) a box-shaped cartridge for a stapler, that contains a plurality of sheet-shaped staple connecting bodies of a predetermined length arranged in a row, and is composed of one piece of sheet-shaped member with a thickness smaller than the height of a protrusion provided in the magazine portion, wherein (a) when cutouts provided in the cartridge corresponding to positions of the protrusion are engaged with the protrusion provided in the magazine portion, the protrusion lifts up the sheet-shaped staple connecting body in the cartridge;

(b) the cutouts are formed at equivalent positions in the front and the rear of the cartridge to have same shapes, so that at least one row of the sheet-shaped staple connecting body lifted up by the protrusion can pass in the cutouts;

(c) a flexible tab, having a length from an upper portion of the respective cutout to a bottom portion of the cartridge, hangs down (d) a hole is formed in a roof portion of the cartridge, so that the staple pressing member can freely pass therethrough.

(3) The present invention also provides a system in which the stapler and the cartridge are combined with each other, characterized in that: the stapler and the cartridge are respectively used; and the cartridge is charged in the magazine portion of the stapler.

(4) The present invention also provides a cartridge for a stapler according to item (2), wherein in the cartridge, instead of the flexible protrusion having the length from an upper portion of the cutout to a bottom portion of the cartridge in the assembled state of the cartridge, perforations are provided in the staple feeding direction in the cartridge, by which a cutout can be formed, the shape of which is formed so that at least one row of the sheet-shaped staple connecting body can pass.

(5) The present invention also provides a cartridge for a stapler according to item (2), wherein a passage from the magazine portion to the inside of the stapling mechanism is formed so that rows of the sheet-shaped staple connecting bodies can pass in the passage only one by one; and when the sheet-shaped staple connecting body in the cartridge is lifted up by engaging the cutout provided in the cartridge with the protrusion provided in the magazine portion, the position of the passage is substantially the same as the position of the sheet-shaped staple connecting body sent to the stapling mechanism so that the sheet-shaped staple connecting body can pass through.

(6) The present invention also provides a cartridge for a stapler according to item (2), wherein the staple pressing member can freely pass in the hole provided in the roof portion of the cartridge and the sheet-shaped staple connecting body can not pass in the hole.

BRIEF DESCRIPTION OF THE DRAWINGS

FIG. 6 is a view showing an outline of the state in which the sheet-shaped staple connecting bodies in the cartridge are used up.

FIG. 7 is a view showing an outline of the state in which the handle is lifted up.

FIG. 8 is a view showing an outline of the state in which a new cartridge is attached to the magazine portion.

Figure 1:
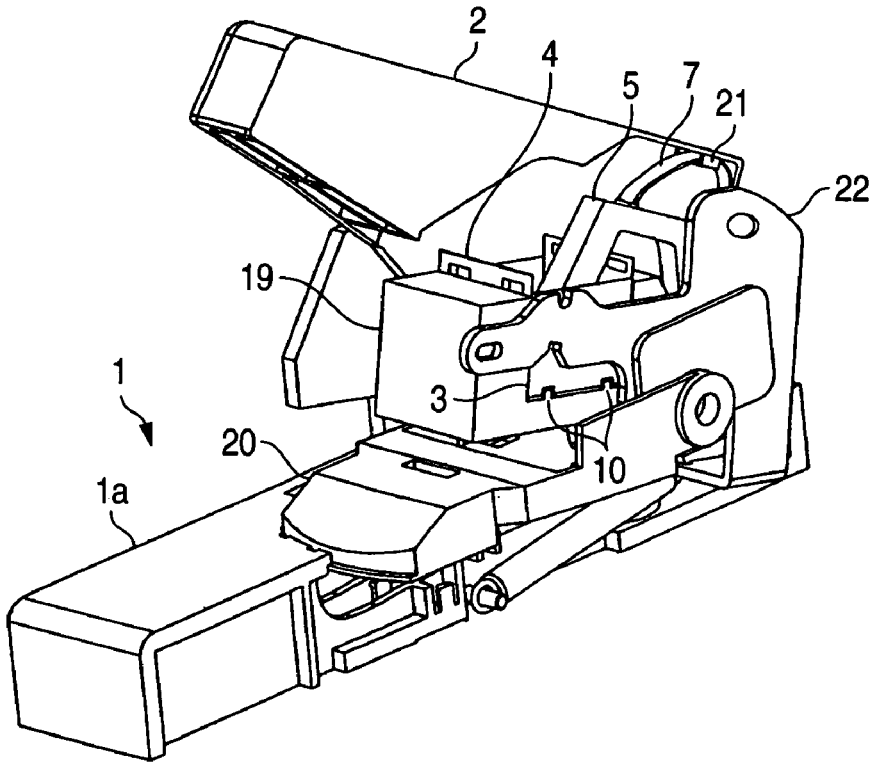
FIG. 1 is a view showing an inner structure of a manual stapler.

Note in the drawings, reference numeral 1 is a stapler, reference numeral 2 is a handle, reference numeral 3 is a magazine portion, reference numeral 4 is a cartridge, reference numeral is a C-shaped arm member, reference numeral 7 is a band-shaped member, reference numeral 8 is a pressing member, reference numeral 9 is a sheet-shaped staple connecting body, reference numeral 10 is a protrusion, reference numeral 14 is a cutout, reference numeral 15 is a tongue-shaped piece, reference numeral 18 is a lid portion, reference numeral 19 is a stapling mechanism and reference numeral 23 is a feeding mechanism.

DESCRIPTION OF THE PREFERRED EMBODIMENTS

Referring to the drawings, an embodiment of the present invention will be explained below.

In this connection, the stapling mechanism of the stapler of the present invention including a driver operating structure and clinching mechanism is similar as that of the electric stapler in which the conventional sheet-shaped staple connecting body is used. Therefore, the detailed explanations of the stapling mechanism of the stapler of the present invention are omitted here.

FIG. 1 is a view showing an inner structure of the manual stapler 1 in which a sheet-shaped staple connecting body is used in the present invention.

In the same manner as the manual stapler in which the conventional C-shaped staples are used, the manual stapler 1 includes a pedestal 1*a*, a stapling mechanism 19 and a clinching mechanism 20. Reference numeral 2 is a handle. When the handle 2 is pressed with a hand, the stapling mechanism 19, which is pivotally attached to the pedestal 1*a*, is operated.

In the front portion of the stapling mechanism 19 (on the right in the drawing), the magazine portion 3 is provided, and the cartridge 4 is accommodated in the magazine portion 3. There are provided four protrusions 10 in the magazine portion 3, that is, the four protrusions 10 are respectively provided in the front, at the rear, on the right and on the left of the magazine portion 3. These protrusions 10 are engaged with the cutouts 14 formed in the cartridge 4. When the cartridge 4 is held by the link 22 which is one part of the stapling mechanism, the cartridge 4 is charged in the magazine portion 3.

Figure 2:
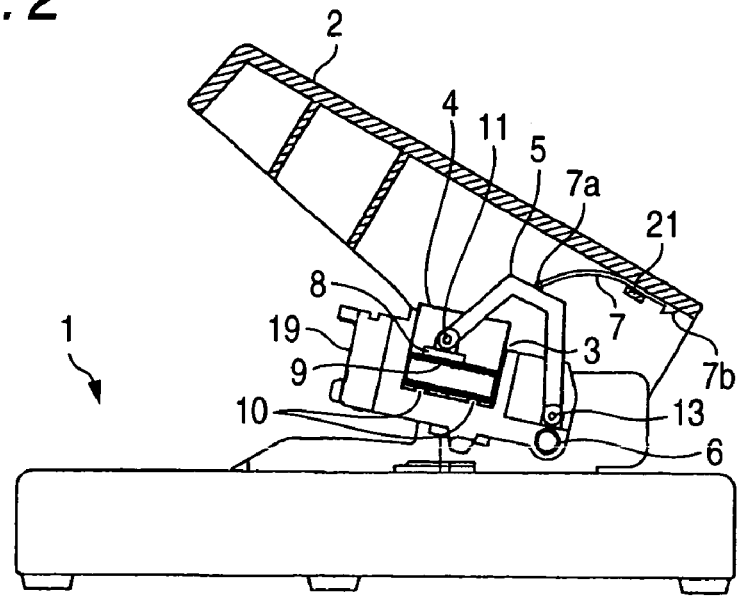
FIG. 2 is a laterally sectional view of the manual stapler.

FIG. 2 is a laterally sectional view of the manual stapler 1. In the handle 2, the C-shaped arm member 5 is provided. One end of the C-shaped arm member 5 is pivotally supported by the front portion of the magazine portion 3 via the hinge 13 arranged in the front portion of the stapling mechanism 19. The hinge 6 is a center of the rotation of the magazine portion 3 with respect to the pedestal. When the handle 2 is pressed down as described above, the magazine portion 3 and the stapling mechanism 19 are rotated round the hinge 6, so that the stapler can conduct a stapling motion.

As shown in FIG. 1 and FIG. 2, the pressing member 8 capable of freely coming in and out from the cartridge 4 is arranged at the other end portion of the C-shaped arm member 5. This pressing member 8 is pivotally supported by the hinge 11. The pressing member 8 is provided for pressing the sheet-shaped staple connecting body 9 to a bottom portion of the magazine portion 3. At an upper end portion of the C-shaped arm member 5, one end portion of the band-shaped member 7 is pivotally supported by the band-shaped member hinge 7*a*. The band-shaped member 7 slidably penetrates in the hook member 21 arranged on an upper face of the inside of the handle. The band-shaped member 7 is not disengaged from the hook member 21 by the pawl-shaped engaging piece 7*b* provided at the end portion on the other side of the band-shaped member hinge 7*a*.

Next, the cartridge structure will be explained below.

FIG. 3 is a view showing a cartridge used being attached to the stapler 1. The cartridge 4 is composed of sheets of paper made of rigid pulp, sheets of paper made of waste paper material, sheets of paper, on which coating is provided, sheets of synthetic paper or thin sheets made of plastics. This cartridge 4 is composed of only a single part 4*a*. The part 4*a* is formed by means of punching or pressing in the same manner as that of a case in which a developed form is made for a common structure made of paper.

Figure 3A:
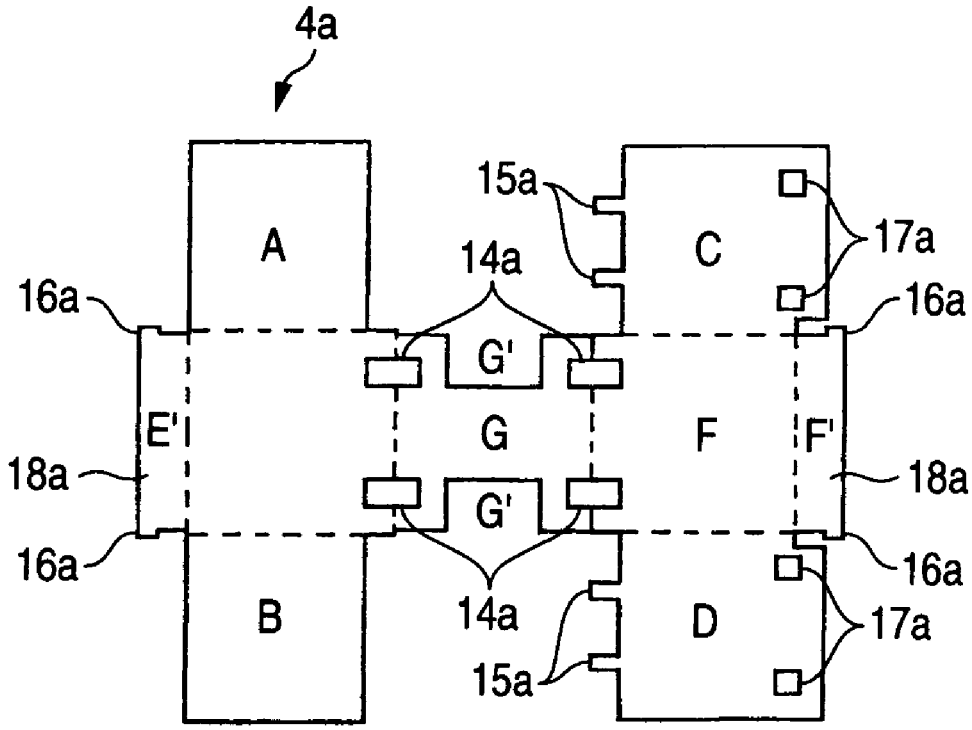
FIG. 3A is a development view of a cartridge used for a stapler of the present invention.

As described in FIG. 3A, in the same manner as that of making a development of a box, the part 4*a* is mainly composed of portions A to G and portions E' and F'. Two tongue pieces 15*a* are attached to portion C. Two tongue pieces 15*a* are also attached to portion D. That is four tongue pieces 15*a* are attached to portions C and D in total. Two pawls 16*a* are attached to portion E'. Two pawls 16*a* are also attached to portion F'. That is, four pawls 16*a* are attached to portions E' and F' in total.

Two engaging holes 17*a* are formed in portion C. Two engaging holes 17*a* are also formed in portion D. That is, four engaging holes 17*a* are formed in portions C and D in total. Two receiving holes 14*a* are formed between portions G and E. Two receiving holes 14*a* are also formed between portions G and F. That is, four receiving holes 14*a* are formed in total.

Portion G' is a cutout portion, which is a recess used so that the mechanism for feeding the sheet-shaped staple forming body 9 can smoothly feed the sheet-shaped staple forming body 9 being meshed with the sheet-shaped staple forming body 9 when the part 4*a* is assembled into a cartridge.

In the case of assembling the part 4*a*, all folds (portions expressed by the broken lines in FIG. 3(*a*)) are folded so that portion C can come to the surface of portion A and portion D can come to the surface of portion B, and portions A and C and portions B and D are respectively fixed to each other by means of bonding or ultrasonic welding.

Into the part 4*a* which is substantially formed into a box shape by the above procedure, an appropriate quantity of sheet-shaped staple forming bodies 9 are inserted from the bottom face being put on each other so that each staple can be parallel with portions C and D. In this connection, as described in FIG. 4, after the appropriate quantity of sheet-shaped staple connecting bodies have been put into the box, the auxiliary sheet 24 made of paper or synthetic paper may be put on the uppermost portion of the sheet-shaped staple connecting bodies.

Figure 3B:
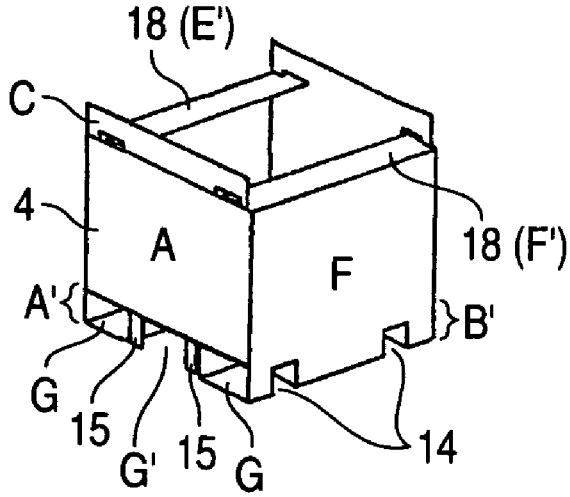
FIG. 3B is a perspective view showing a state of assembling of the cartridge.

Next, toward the inside of the box-shaped part 4*a* containing the sheet-shaped staple connecting bodies 9, portions E' and F' are folded toward the inside making a right angle. Four pawl-shaped pieces 16*a* of portions E' and F' are respectively pushed into and engaged with the four engaging holes 17*a*, which are opposed to the four pawl-shaped pieces 16*a*. Then, the cartridge 4 containing the sheet-shaped staple connecting bodies 9 shown in FIG. 3B is completed.

In this connection, portions E' and F' become the lid portions 18, 18 as they are when portions E' and F' are folded. Therefore, the sheet-shaped staple forming bodies 9 can be prevented from being scattered from an upper face of the cartridge 4 by the lid portions 18, 18. The interval 18*b*, which is smaller than the length of each staple of the sheet-shaped staple connecting body and longer than the width of the pressing member 8, is provided between the two lid portions 18, 18 so that the pressing member 8 can freely pass on an upper face of the cartridge 4.

In this cartridge 4, in the same portions of the front and the rear (portions C and D), cutout portions, the dimensions and profiles of which are the same with each other so that the sheet-shaped staple connecting body can pass through, are provided. Cutout portion A' is provided in the lower portion of portion A, and cutout portion B' is provided in the lower portion of portion B. Due to the foregoing, profiles of the front and rear of the cartridge are substantially the same with each other from the functional viewpoint, which is effective to abolish the polarity in the longitudinal direction of the cartridge when the cartridge is charged into the magazine portion 3.

The tongue pieces 15*a* are provided for temporarily holding the sheet-shaped staple bodies so as to prevent the sheet-shaped staple bodies from being scattered when the cartridge 4 is conveyed as a product or when the cartridge 4 is taken out from a box for sales and attached to the stapler 1. The tongue pieces 15*a* can be elastically deformed when the cartridge 4 is attached to the magazine portion 3 and each staple is sent out to the stapling mechanism 19 for stapling work.

As long as the above object can be accomplished, one tongue-shaped piece 15 may be provided on one face. Alternatively, three or more tongue-shaped pieces 15 may be provided on one face.

Figure 4:
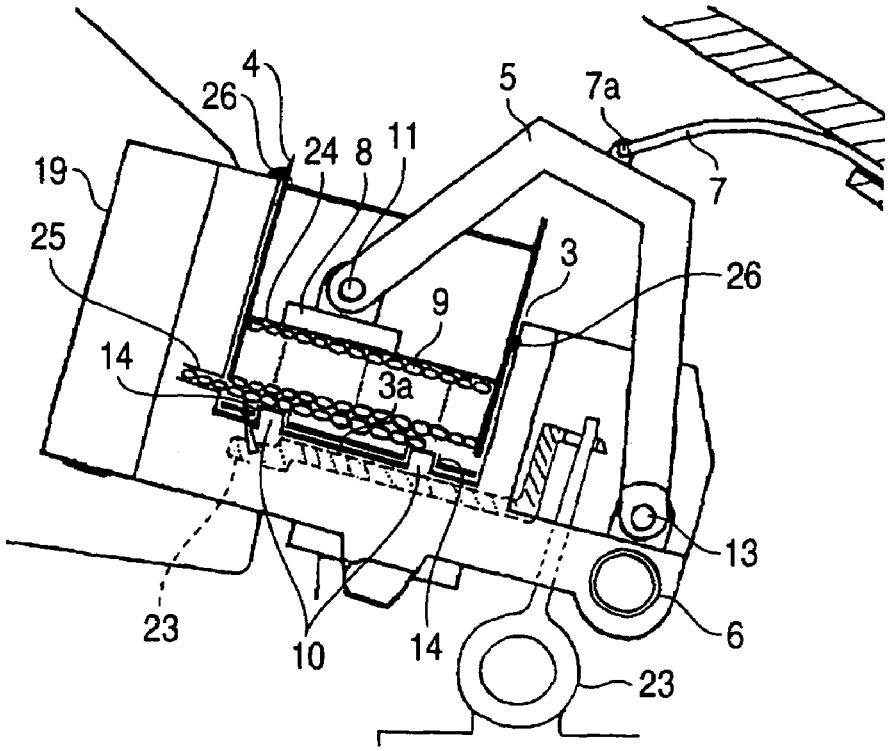
FIG. 4 is a view showing an outline of the structure in which a cartridge is attached to a magazine portion of the stapler.

FIG. 4 is a view showing an outline of the structure in which the cartridge 4 is attached to the magazine portion 3 of the stapler 1 of the present invention.

The hinge 13 always pushes the C-shaped arm member 5 anticlockwise in FIG. 4 with an elastic structure not shown which is composed of a twist coil spring or an elastomer member. When the protrusion 10 is engaged with the cutout 14 provided in the cartridge 4, there is no possibility that the cartridge 4 is greatly oscillated with respect to the magazine portion 3 and the cartridge 4 is erroneously attached to the magazine portion 3 being rotated by 90°.

The height of the protrusion 10 is larger than the thickness of material composing the cartridge 4, and the bottom portion of the cartridge 4 substantially comes into contact with the bottom face 3*a* of the magazine portion 3. Due to the foregoing, the sheet-shaped staple connecting body 9 is supported by the protrusion 10 and lifted up in the cartridge 4. Accordingly, there is no possibility that the sheet-shaped staple connecting body 9 is strongly rubbed on the bottom portion of the inner face of the cartridge 4 and the cartridge 4 is abraded and damaged.

In the cartridge 4, portion G' is formed into a cutout portion. Therefore, the sheet-shaped staple connecting body 9 is exposed from portion G'. Due to the foregoing, the feeding mechanism 23 can be engaged with the sheet-shaped staple connecting body 9. Therefore, in the same manner as that of a common electric stapler incorporated into a copier, the feeding mechanism 23 is operated each time the stapling operation is conducted, and the sheet-shaped staple connecting body 9 is successively sent to the striking waiting position, which is located in the stapling mechanism, via the passage 25.

At this time, since the durable force of the tongue-shaped piece 15*a* is lower than the feeding force of the feeding mechanism 23, when the sheet-shaped staple connecting body 9 is sent into the stapling mechanism 19, the tongue-shaped piece 15*a* is elastically or plastically deformed. Therefore, the tongue-shaped piece 15*a* does not obstruct the feeding motion of the sheet-shaped staple connecting body 9.

When the dimensions of the passage 25 communicating with the inside of the stapling mechanism 19 are made to be values by which the rows of the sheet-shaped staple connecting bodies 9 can pass in the passage 25 one by one and when the passage 25 is provided in such a manner that the position of the passage 25 is substantially the same as the position of the sheet-shaped staple connecting body located at the lowermost portion under the condition that the sheet-shaped staple connecting body 9 is held and lifted up by the protrusion, as long as the sheet-shaped staple connecting body 9 is normally lifted up in the cartridge 4, even if the cartridge 4 is a little lifted up in the magazine portion 3 while the stapler is being used, there is no possibility that two rows or more of the sheet-shaped staple connecting bodies 9 are simultaneously fed, that is, the sheet-shaped staple connecting bodies 9 can be always smoothly fed one by one to the stapling mechanism.

The fixing member 26 for preventing the cartridge 4 from being oscillated or lifted up may be provided in the magazine portion 3 or in the neighborhood of the magazine portion 3. It can be considered to provide the fixing member as follows. The fixing member may be a block-shaped or sheet-shaped member made of elastic material. The fixing member fixes the cartridge 4 in the magazine 3 by the friction with the wall face. Alternatively, the fixing member may be a pawl-shaped or hook-shaped member and engages with the outer edge portion or the engaging hole 17*a* of the cartridge 4 so as to fix the cartridge 4 in the magazine portion 3.

Next, referring to FIGS. 5 to 9, explanations will be made into a state in which the stapler 1 and the cartridge are normally used in the present invention.

Figure 5:
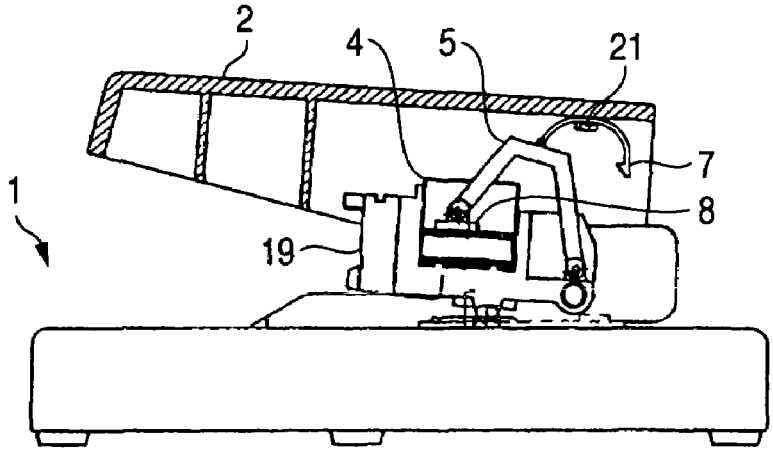
FIG. 5 is a view showing a state in which the stapler and the cartridge are normally used in the case where the cartridge is attached to the magazine portion.

FIG. 5 is a view showing a state in which the stapler 1 and the cartridge 4 are conducting a normal stapling work. In the same manner as that of the common manual stapler, in the stapler 1, each time the handle is press down, sheets of paper are stapled with a staple by the stapling mechanism 19. When the handle is returned, the next staple is fed to the stapling mechanism 19.

Figure 6:
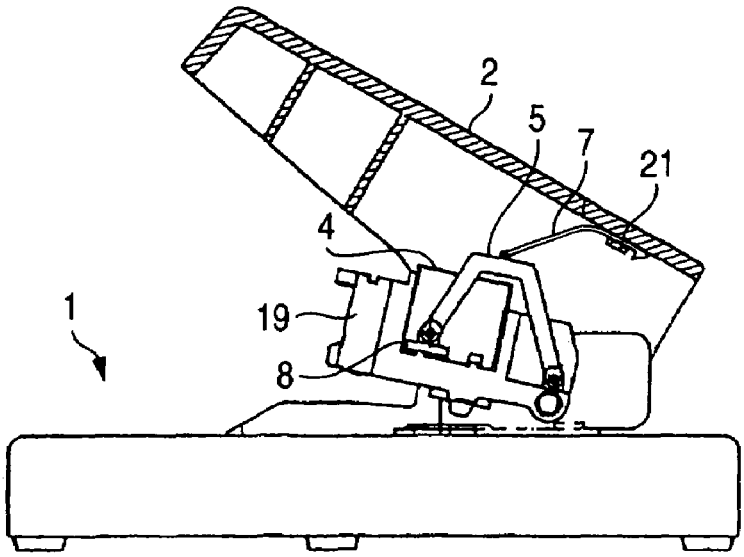
FIG. 6 is a view showing a state in which the stapler and the cartridge are used, that is.
Figure 7:
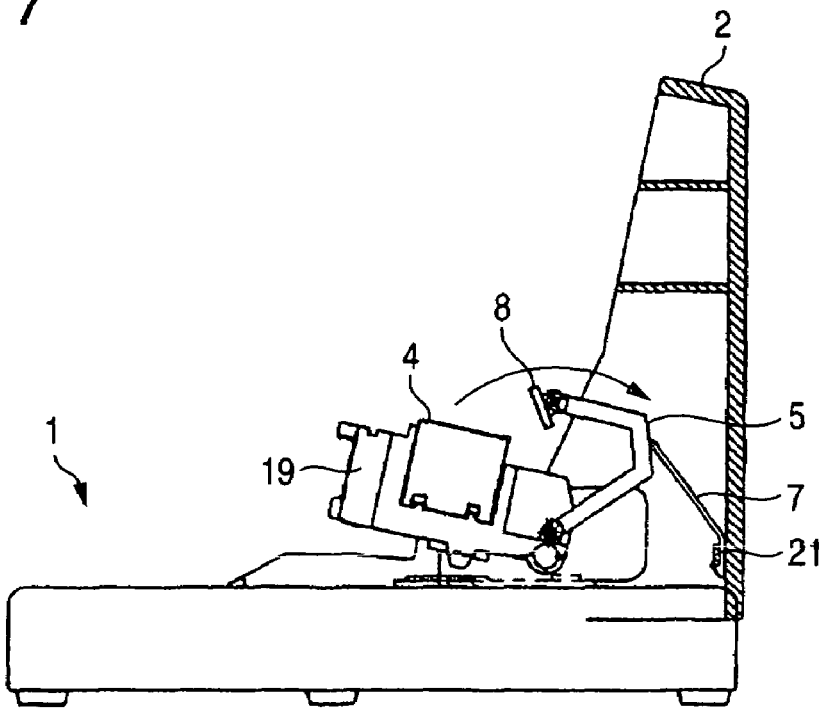
FIG. 7 is a view showing a state in which the stapler and the cartridge are used, that is.

FIG. 6 is a view showing a state in which the sheet-shaped staple connecting bodies 9 in the cartridge 4 have been used up. As shown in FIG. 6, when all the sheet-shaped staple connecting bodies 9 in the cartridge 4 have been used up, the handle 2 is lifted up clockwise. Therefore, the handle 2 is lifted up as shown in FIG. 7.

When the handle 2 is raised as described above, since the hooking piece 7*b* of the band-shaped member 7 is engaged with the hooking member 21, the C-shaped arm member 5 is raised following the handle 2. Therefore, the pressing member 8 is separated from the cartridge 4. According to this procedure, the cartridge 4 can be freely picked up from the magazine portion 3.

Figure 8:
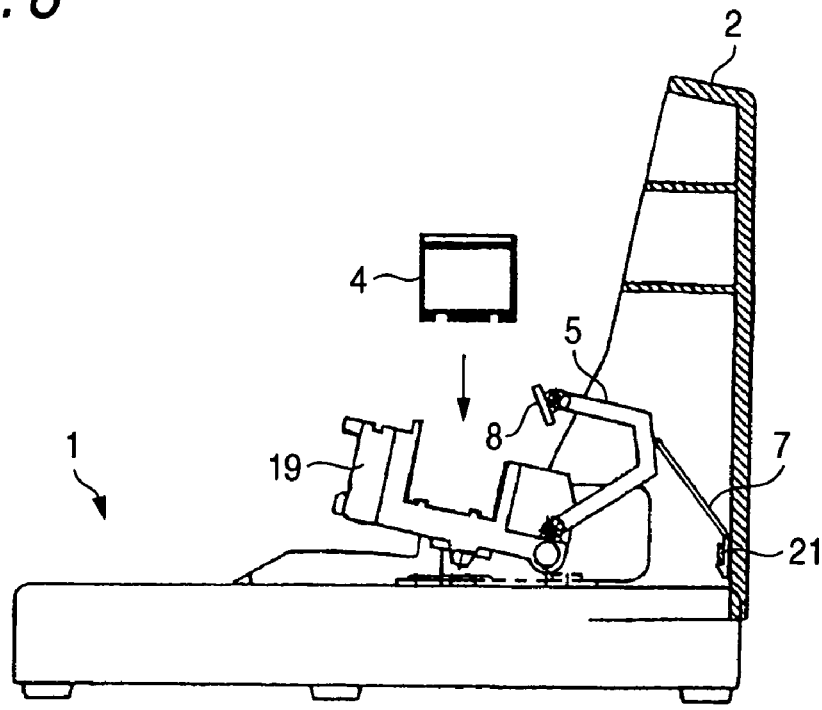
FIG. 8 is a view showing a state in which the stapler and the cartridge are used, that is.

FIG. 8 is a view showing an outline of the state in which a new cartridge is attached to the magazine portion. In order to charge the new cartridge 4, which contains the sheet-shaped staple connecting body 9, into the magazine portion 3, the cartridge 4 is put into the magazine portion 3 correctly with respect to the vertical and the lateral direction. At this time, since the cartridge 4 does not have polarity with respect to the longitudinal direction, the cartridge 4 may be freely set in the longitudinal direction.

When the cartridge 4 is accommodated at a correct position in the magazine 3, the cutout 14 provided in the cartridge 4 is engaged with the protrusion 10. When the sheet-shaped staple connecting body 9 is set on the protrusion 10, the sheet-shaped staple connecting body 9 is lifted up in the cartridge 4.

Figure 9:
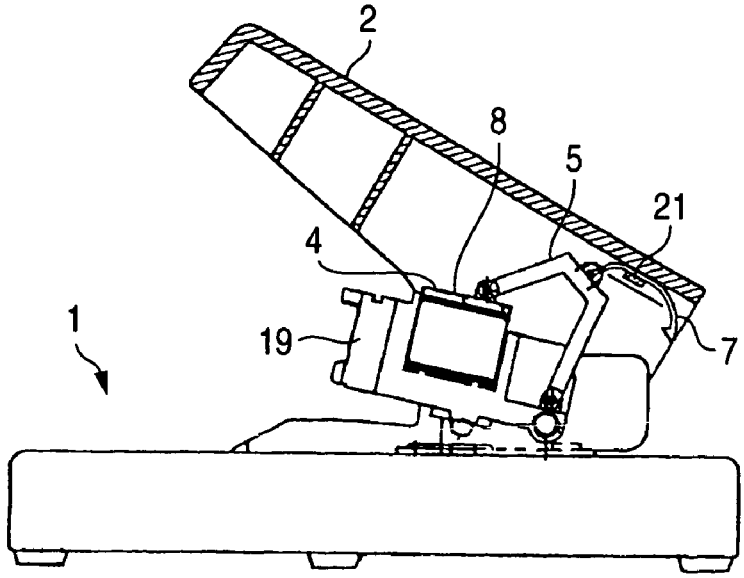
FIG. 9 is a view showing an outline of the state in which the new cartridge has been attached to the magazine portion and the stapler and cartridge can be normally used.

Finally, when the handle 2 is rotated counterclockwise being tilted and closed, the C-shaped arm member 5 is rotated counterclockwise round the hinge 13. At the forward end portion of the C-shaped arm member 5, the pressing member 8 is pivotally attached to the hinge portion 11. Since the pressing member 8 can freely come in and out from the interval 18*b* described before, the pressing member 8 presses the sheet-shaped staple connecting body 9 to the bottom portion of the inner face of the cartridge 4. Therefore, as shown in FIG. 9, the cartridge 4 is completely fixed to the magazine portion 3, and the stapling work can be performed by the method shown in FIG. 5.

Next, another embodiment of the cartridge, which is used for the stapler 2 of the present invention, will be explained below.

FIG. 10 is a view showing a cartridge of the second embodiment used for the stapler 1 of the present invention. This cartridge 104 is made of the same material as that of the cartridge 4. This cartridge 104 is composed of a single part 104*a*. The part 104*a* is formed by means of punching or pressing in the same manner as that of the part 4*a*.

Figure 10A:
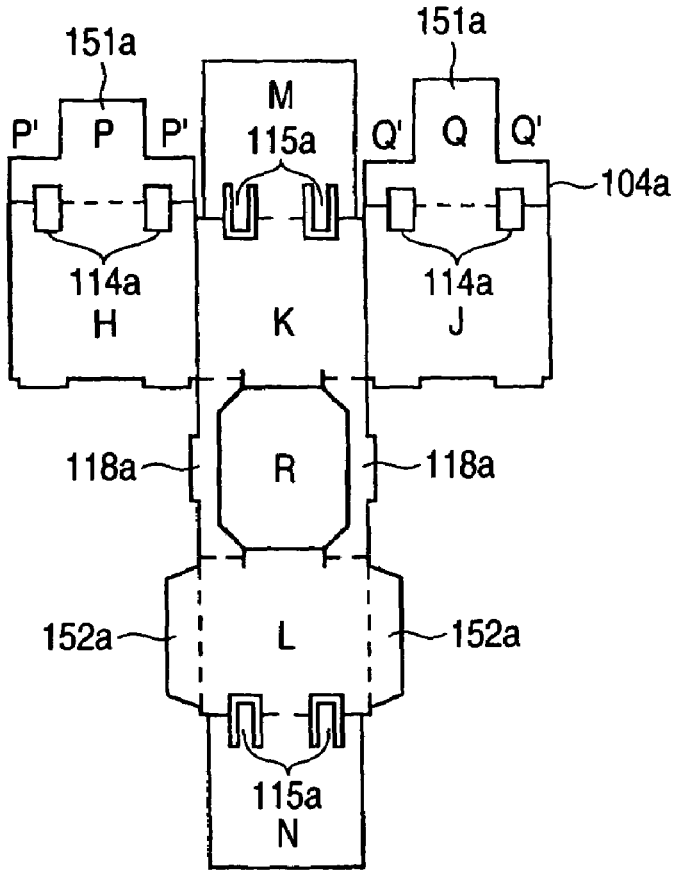
FIG. 10A is a development view showing another embodiment of the cartridge used in the stapler of the present invention, and FIG. 10(*b*) is a perspective view showing an assembling state of another embodiment of the cartridge used in the stapler of the present invention.

As described in FIG. 10A, the part 104*a* is made by the same procedure as that of making a development of a box. The part 104*a* is mainly composed of portions H to R. In portion M, two tongue-shaped pieces 115 are provided. In portion N, two tongue-shaped pieces 115 are also provided. That is, four tongue-shaped pieces 115 are provided in total.

In portion L, two bonding margins, one is on the right and the other is on the left, are provided. Between portions H and P, two receiving holes 114*a* are provided. Between portions J and Q, two receiving holes 114*a* are also provided. That is, four receiving holes 114*a* are provided in total. Portions P', P' and portions Q', Q' are cutout portions. When the part 104*a* is assembled into a cartridge, portions P'2, P'2, which are generated by the combination of portion P' with portion Q' and also by the combination of portion P' with portion Q', become recesses corresponding to the operation of the feeding mechanism for feeding the sheet-shaped staple connecting body 9. Therefore, the feeding mechanism 23 can smoothly feed the sheet-shaped staple connecting body 9.

In the case of assembling the part 104*a*, all folds (portions expressed by the broken lines in FIG. 1A) are folded so that portion K can come to the surface of portion M and portion L can come to the surface of portion N, and portions M and K, portions N and L, portion H and the bonding margin 152*a*, and portion J and the bonding margin 152*a* are respectively fixed to each other by means of bonding or ultrasonic welding.

Into the part 104*a* which is substantially formed into a box shape by the above procedure, an appropriate quantity of sheet-shaped staple forming bodies 9 for sales and use are inserted from the bottom opening portion being put on each other so that each staple can be parallel with portions K and L. In this connection, as described in FIG. 4, before the appropriate quantity of sheet-shaped staple connecting bodies have been put into the box, the auxiliary sheet 24 made of paper or synthetic paper may be put on the uppermost portion of the sheet-shaped staple connecting bodies.

Figure 10B:
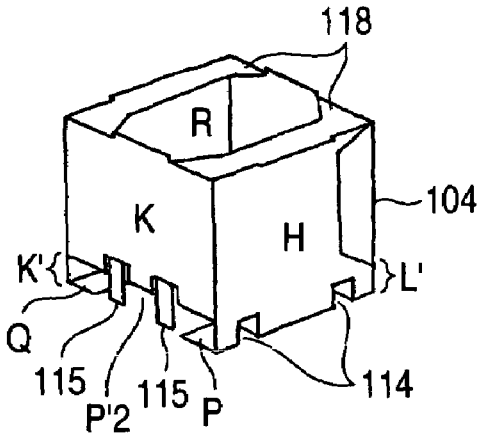

Next, while the sheet-shaped staple connecting bodies 9 are being contained, portions P and Q are folded making a right angle and put on each other so that either portion P or portion Q can be put in an upper portion. Then, portions are fixed to each other by means of bonding or welding. In this way, the cartridge 104 containing the sheet-shaped connecting body 9 shown in FIG. 10B is completed.

In this connection, in portion R, since the opening portion 118*b*, the length of which is smaller than the length of each staple and the width of which is larger than the width of the pressing member 8, is provided, the sheet-shaped staple connecting body 9 is prevented from being scattered from an upper face of the cartridge 104, and the pressing member 8 can be freely pass on an upper face of the cartridge 104.

In this cartridge 104, in the same portions of the front and the rear (portions K and L), cutout portions, the dimensions and profiles of which are the same so that the sheet-shaped staple connecting body can pass through, are provided. Cutout portion K' is provided in the lower portion of portion K, and cutout portion L' is provided in the lower portion of portion L. Due to the foregoing, profiles of the front and rear of the cartridge are substantially the same with each other from the functional viewpoint, which is effective to abolish the polarity in the longitudinal direction of the cartridge when the cartridge is charged into the magazine portion 3.

The tongue pieces 115 are provided for temporarily holding the sheet-shaped staple bodies so as to prevent the sheet-shaped staple bodies from being scattered when the cartridge 104 is conveyed as a product or when the cartridge 104 is taken out from a box for sales and attached to the stapler 1. The tongue pieces 115 can be elastically deformed when the cartridge 104 is attached to the magazine portion 3 and each staple is sent out to the stapling mechanism 19 for stapling work. As long as the above object can be accomplished, one tongue-shaped piece 115 may be provided on one face. Alternatively, three or more tongue-shaped pieces 115 may be provided on one face.

Figure 11A:
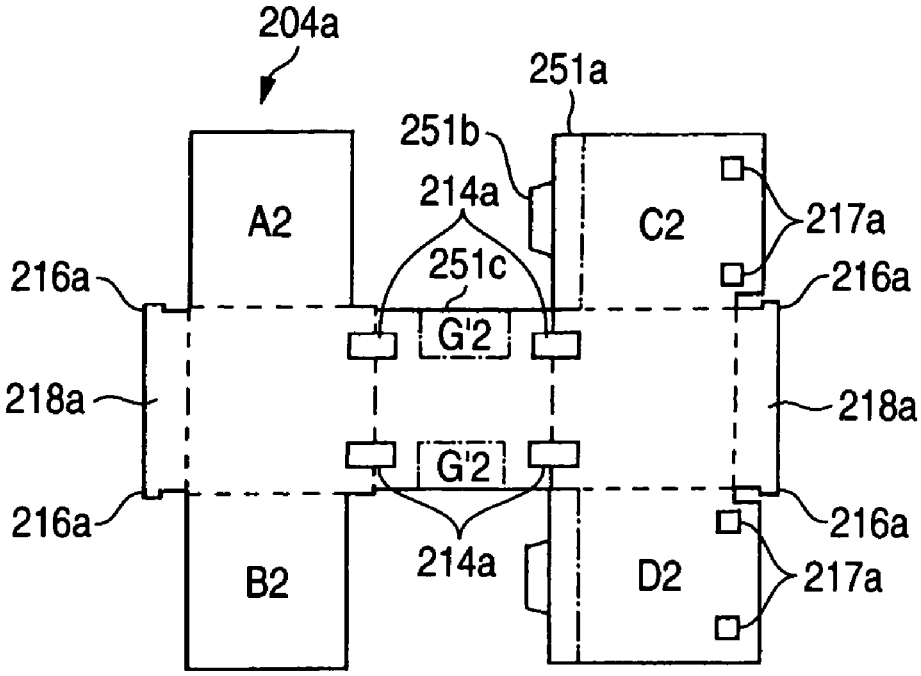
FIG. 11A is a development view showing the third embodiment of the cartridge used for the stapler of the present invention, and FIG. 11(*b*) is a perspective view showing an assembling state of the third embodiment of the cartridge used for the stapler of the present invention.

The third embodiment of the cartridge used for the stapler 1 of the present invention may be a cartridge 204 shown in FIG. 11A and a cartridge 204 which is composed of the part 204*a*.

The form and structure of the part 204*a* are similar to those of the cartridge 4. However, instead of the tongue-shaped pieces 15*a* which are a means for holding the sheet-shaped staple connecting bodies 9 so that the sheet-shaped staple connecting bodies 9 can be prevented from being scattered in the process of conveyance before being used, the following are provided. They are:

pieces 251*a*, 251*a* respectively formed on one side of portion C2 close to portion A2 and also formed on one side of portion D2 close to portion B2, wherein the pieces 251*a*, 251*a* are formed by perforations;

pieces 251*c*, 251*c* provided in one portion of portion G2, wherein these pieces 251*c*, 251*c* are formed by perforations; and bonding margins 251*b*, 251*b* provided in the pieces 251*a*, 251*a* on the side of portions A2 and B2, wherein the bonding margins 251*b*, 251*b* are bonded or welded to the pieces 251*c*, 251*c*.

In this connection, the perforations are expressed by one-dotted chain lines in FIG. 11.

The method of charging the cartridge 204 into the stapler 1 and the method of using the cartridge 204 are substantially the same as those of the cartridge 4. Therefore, the explanations are omitted here.

Figure 11B:
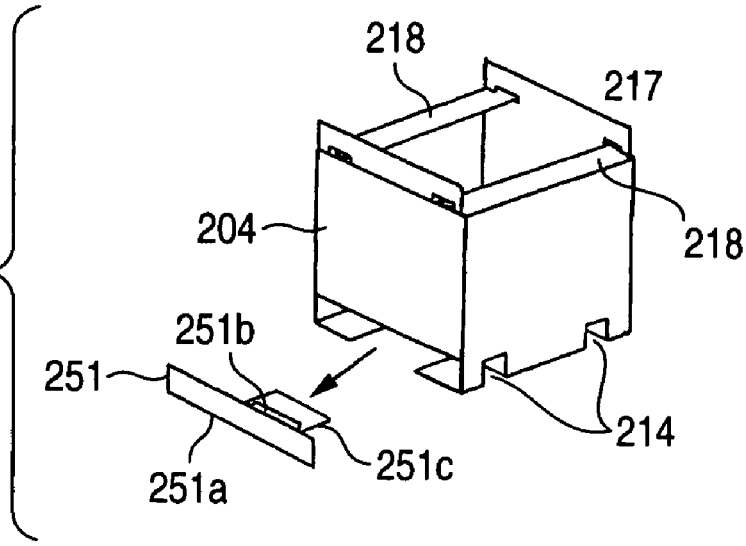

When the part 204*a* is assembled, it is possible to obtain the cartridge 204 shown in FIG. 11B. In the case of using the cartridge 204, the portion 251, in which the piece 251*a*, the bonding margin 251*b* and the piece 251*c* are integrated into one body, is torn away from the cartridge 204 along the perforations, and the cartridge 204 is attached to the magazine portion 3 of the stapler 1 as it is. Due to the foregoing, in the same manner as that of the cartridges 4 and 104, the sheet-shaped staple connecting bodies 9 can be drawn out in the magazine portion 3.

Referring to the specific embodiments, the present invention is explained above in detail. However, it should be noted that various variations may be made by those skilled in the art without departing the spirit and scope of the present invention.

The present application is based on the Japanese Patent Application (Patent Application No. 2001-304565) applied on Sep. 28, 2001. The contents of the above application is taken in here as a reference.

INDUSTRIAL APPLICABILITY

As explained above, according to the system, in which the manually driven stapler and the cartridge used for the stapler of the present invention are combined with each other, it is possible to charge a large number of staples without unnecessarily increasing the dimensions of the stapler.

The cartridge is inexpensive and can be manufactured and assembled easily, and further the structure is simple. Furthermore, any specific parts are required for containing the cartridge, and rubbish is seldom generated.

From the structural viewpoint, the cartridge can be used in any direction with respect to the longitudinal direction. Accordingly, there is a low risk that the cartridge is set in an erroneous direction. Although the cartridge is formed into a simple box-shape, since the sheet-shaped connecting body is lifted up in the cartridge, the cartridge is seldom damaged by the friction with the sheet-shaped staple connecting body. Only when the cartridge is put, it can be engaged with the magazine portion which is located at a position where the cartridge must be set.

Even when the cartridge itself does not have a means for pressing the sheet-shaped staple connecting body to the floor of the cartridge although the electric stapler built in the conventional copier has such a means, while the above pressing means provided on the stapler side is being received by the cartridge, the staplers can be prevented from being scattered.

Further, in the process of conveyance, the sheet-shaped staple body can be prevented by the tongue-shaped pieces, which can be elastically deformed, from dropping from the cartridge by the means for preventing the staples from dropping. Further, when the cartridge is attached to the stapler, there is no possibility that the sheet-shaped staple connecting body is prevented from being fed at the time of the use of the stapler.

Further, since the means for preventing the staples from dropping, which can be easily torn away from the cartridge along perforations, is provided, there is no possibility that the sheet-shaped staple connecting body drops from the cartridge in the process of conveyance. Furthermore, it is possible to easily distinguish the cartridge whether it has been used or not. When the cartridge is attached to the stapler, there is no possibility that the feed of the sheet-shaped staple connecting body is obstructed.

When the sheet-shaped staple connecting body in the cartridge is lifted up by the above method, since the passage from the cartridge to the stapling mechanism of the stapler is composed so that only one row of the sheet-shaped staple connecting body can pass in the passage, there is no possibility of a defective feeding motion in which two rows or more of the sheet-shaped staple connecting bodies are fed to the stapling mechanism.

The invention claimed is:

1. A box-shaped cartridge for a stapler, that contains a plurality of sheet-shaped staple connecting bodies in which a plurality of linear staples are continuously connected to each other, and is composed of one piece of sheet-shaped member having a thickness smaller than the height of a protrusion provided in a magazine portion of the stapler, the box-shaped cartridge comprising:

a plurality of first cutouts provided in the cartridge overlapping a bottom surface and a side surface distributed along opposing side surfaces for engaging with the protrusion in the magazine portion, wherein the protrusion lifts up the sheet-shaped staple connecting bodies in the cartridge when the cartridge is accommodated in the magazine portion;

a pair of second cutouts equivalently formed in a front surface and a rear surface of the cartridge adjacent to the bottom surface, for passing therethrough at least one sheet of the sheet-shaped staple connecting bodies lifted up by the protrusion;

a hole formed in a top surface roof portion of the cartridge for freely passing therethrough a pressing member of the stapler; and a pair of third cutouts located adjacent to the pair of second cutouts, wherein a feeding mechanism of the stapler is engaged with one of the sheet-stapled staple connecting bodies through at least one of the third cutouts so as to feed the one of the sheet-stapled staple connecting bodies.

2. The box-shaped cartridge according to claim 1, further comprising:

flexible tabs hanging down from an upper portion of respective second cutouts to a bottom portion of the cartridge.

3. The box-shaped cartridge according to claim 1, further comprising pieces formed by perforations, wherein the pair of second cutouts are formed when the pieces are torn away and separated from the box-shaped cartridge along the perforations.

4. The box-shaped cartridge according to claim 1, wherein the pair of second cutouts are formed in a height position so that a height position of one sheet of sheet-shaped staple bodies lifted up by the protrusion and passing through one of the second cutouts corresponds to a position of a passage formed from the magazine portion to a staple pressing means of the stapler.

5. The box-shaped cartridge according to claim 1, wherein the hole has a size that sheet-shaped staple connecting body can not pass therein.

6. A box-shaped cartridge for a stapler, that contains a plurality of sheet-shaped staple connecting bodies in which a plurality of linear staples are continuously connected to each other, and is composed of one piece of sheet-shaped member having a thickness smaller than the height of a protrusion provided in a magazine portion of the stapler, the box-shaped cartridge comprising:

a plurality of first cutouts provided in the cartridge overlapping a bottom surface and a side surface distributed along opposing side surfaces for engaging with the protrusion in the magazine portion, wherein the protrusion lifts up the sheet-shaped staple connecting bodies in the cartridge when the cartridge is accommodated in the magazine portion;

a pair of second cutouts equivalently formed in a front surface and a rear surface of the cartridge adjacent to the bottom surface, for passing therethrough at least one sheet of the sheet-shaped staple connecting bodies lifted up by the protrusion; wherein positions of the second cutouts are substantially the same as the position of the sheet-shaped staple connecting body located adjacent a lowermost portion of the cartridge under the condition that the sheet-shaped staple connecting body is lifted up by the protrusion; and a hole formed in a top surface roof portion of the cartridge for freely passing therethrough a pressing member of the stapler.

* * * * *